US006695155B1

(12) United States Patent
Sofy et al.

(10) Patent No.: US 6,695,155 B1
(45) Date of Patent: Feb. 24, 2004

(54) IRONING ORGANIZER

(75) Inventors: Janet M. Sofy, Troy, MI (US); Robert T. Solomon, Ray, MI (US)

(73) Assignee: HMS Mfg. Co., Troy, MI (US)

( * ) Notice: Subject to any disclaimer, the term of this patent is extended or adjusted under 35 U.S.C. 154(b) by 0 days.

(21) Appl. No.: 10/329,725

(22) Filed: Dec. 26, 2002

(51) Int. Cl.[7] ..... A47F 5/08
(52) U.S. Cl. ..... 211/87.01
(58) Field of Search ..... 211/87.01, 88.01, 211/96.01, 86.01, 71.01, 134, 150

(56) References Cited

U.S. PATENT DOCUMENTS 2,514,400 A * 7/1950 Larkins ..... 248/117.7
4,834,332 A * 5/1989 Vanderbilt ..... 248/292.14
4,893,770 A * 1/1990 Bejak et al. ..... 248/117.1
D353,247 S * 12/1994 Penny ..... D32/73
5,570,642 A * 11/1996 Lehrman ..... 108/47
D386,864 S * 11/1997 Ratliff et al. ..... D32/73
5,743,417 A * 4/1998 Mathis ..... 211/119
5,810,304 A * 9/1998 Lehrman ..... 248/215
D451,254 S 11/2001 Egan ..... D32/73

* cited by examiner

*Primary Examiner*—Alvin Chin-Shue
*Assistant Examiner*—Sarah Purol
(74) *Attorney, Agent, or Firm*—Howard & Howard

(57) ABSTRACT

The shelf 16 is placed in the storage or shipping position shown in FIG. 2 with the projections 58 disposed in the grooves behind the flanges 34 and engaging the bottoms 60 of the embossments. To prevent the shelf 16 from swinging outwardly, the tabs 64 overlap and are retained behind the fingers 68. A wrapper 18 may be placed around the components 12 and 16 for shipping and display in a retail store. The user would remove the shelf 16 from the stored position and slide the tongues 38 into the grooves (as shown in FIG. 4) until the covers 36 engage the tops 30 for supporting the shelf 16 in the cantilevered position (as shown in FIG. 5).

16 Claims, 5 Drawing Sheets

IRONING ORGANIZER

BACKGROUND OF THE INVENTION

1. Field of the Invention

The subject invention relates to an ironing organizer of the type having arms for supporting the diverging legs of an ironing board and a shelf for supporting an iron and miscellaneous items.

2. Description of the Prior Art

Ironing organizers of the type to which the instant invention pertains are well known in the prior art. An example of one such prior art organizer is shown in U.S. Design Pat. No. D451, 254 to Egan.

This type of organizer, wherein a shelf extends forwardly from a backboard, consumes a relatively large volume of space, which is a detriment in a storage or shipping condition as well as a retail store display.

SUMMARY OF THE INVENTION AND ADVANTAGES

An ironing organizer assembly of this invention comprises a backboard including arms for cradling the legs of an ironing board and a shelf for projecting from the backboard and is characterized by a coupling for removably connecting the shelf to the backboard.

Accordingly, the subject invention provides an ironing organizer assembly that has a compact storage position for storage and shipping and a unique coupling for connecting the shelf to the backboard in either the cantilevered position of the shelf or the storage position of the shelf whereby the combination occupies a relatively small volume for storage and shipping.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE PREFERRED EMBODIMENT

Referring to the Figures, wherein like numerals indicate like or corresponding parts throughout the several views, an ironing organizer assembly is generally shown at 10.

Figure 5:
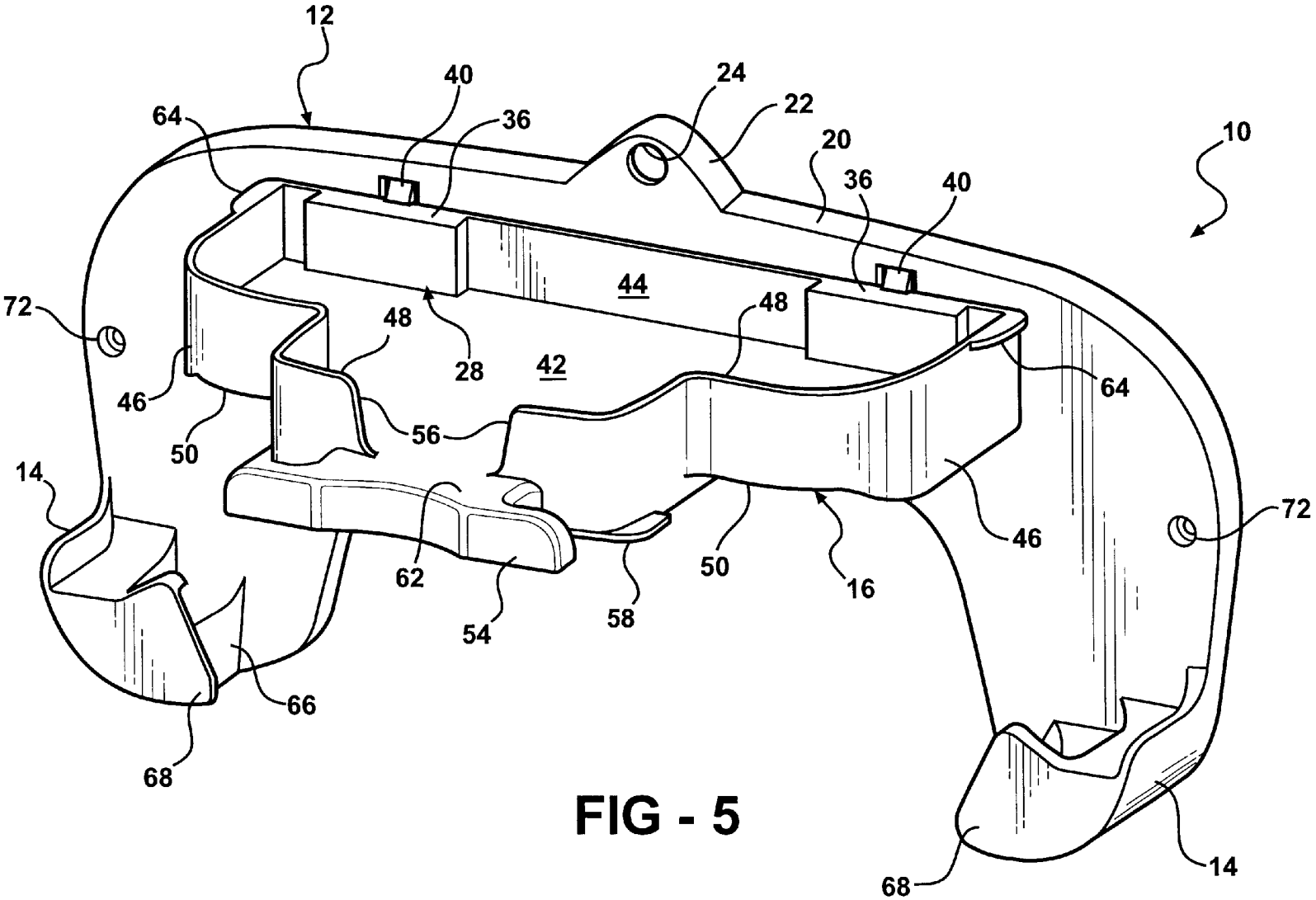
FIG. 5 is a perspective view showing the shelf supported on the backboard in the cantilevered position.

The assembly 10 comprises a backboard, generally indicated at 12, and including arms 14 for cradling the legs of an ironing board (not shown) and a shelf, generally indicated at 16, for projecting from the backboard 12 in a cantilevered position, as shown in FIG. 5.

Figure 1:
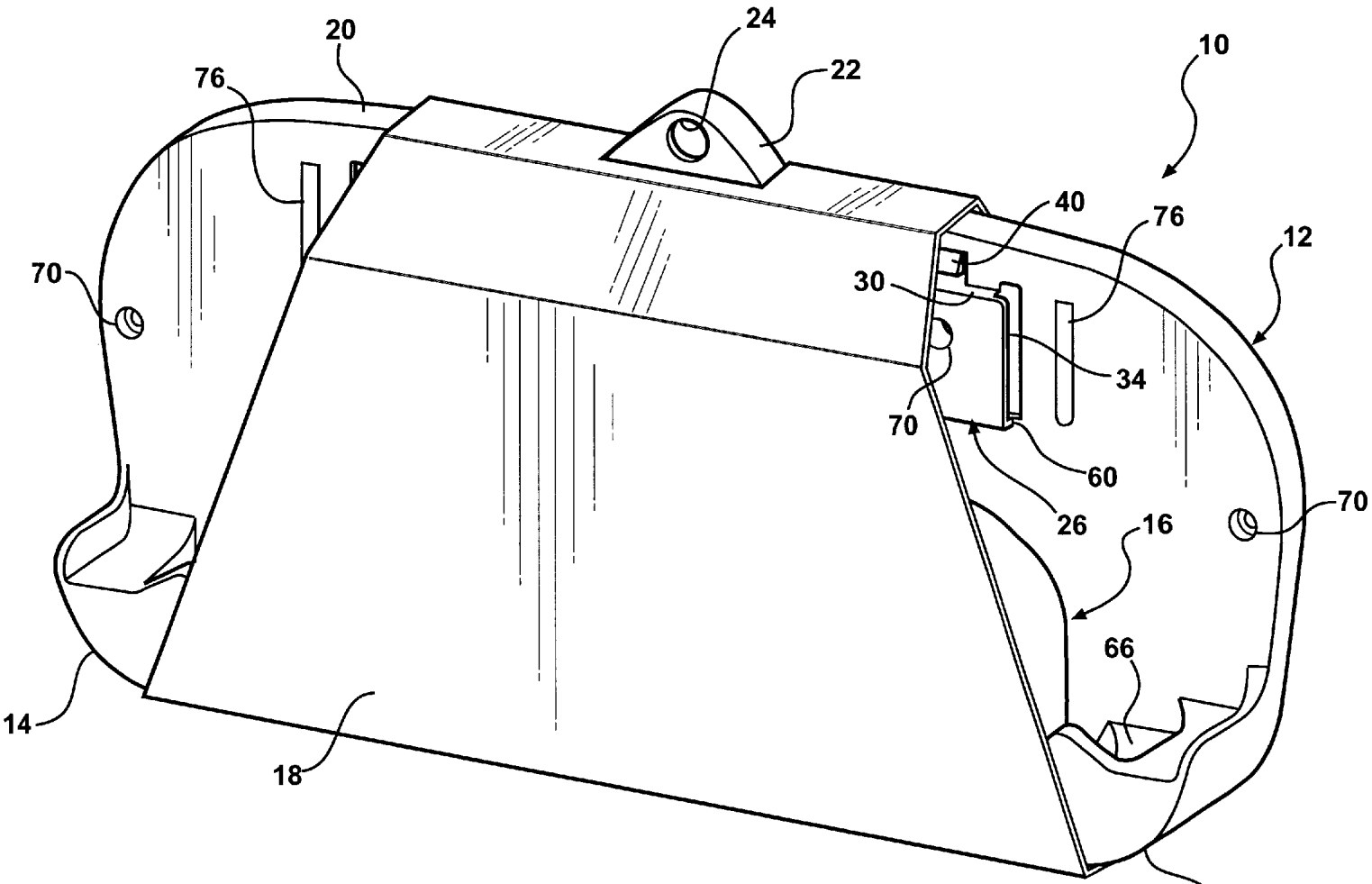
FIG. 1 is perspective view of the subject invention shown in the storage position and encased in a wrapper for shipment and display.

As shown in FIG. 1, a wrapper 18 surrounds the backboard 12 and the shelf 16 in the storage position for shipping and display. The backboard 12 includes an upper shoulder 20 and a nose 22 extending upwardly from the upper shoulder 20 and defining a hole therethrough. The wrapper surrounds the backboard 12 and the shelf 16 in the storage position and engages the upper shoulder 20 and defines an opening 24 with the nose 22 extending therethrough. The wrapper may have information relating to the assembly and use of the assembly for presentation in a retail store as the assembly is hung on a display rack, or the like, via the nose 22 and opening 24.

The assembly 10 is characterized by a coupling for removably connecting the shelf 16 to the backboard 12, either in the overlapping storage position or in the cantilevered position for use.

The coupling includes a backboard connector, generally indicated at 26, and a shelf connector, generally indicated at 28, that mechanically interconnect with one another for supporting the shelf 16 in a cantilevered position extending forwardly from the backboard 12, as shown in FIG. 5. The backboard connector 26 includes a pair of embossments spaced laterally from one another and each having a top 30 and spaced sides 32 with a pair of flanges 34 extending in opposite directions from the sides 32 to define inside grooves facing one another and outside grooves facing towards the ends of the backboard. The shelf connector 28 includes a pair of C-shaped channels each with a cover 36 and opposing tongues 38 for sliding the tongues 38 into the grooves with each cover 36 engaging one of the tops 30 for supporting the shelf 16 in the cantilevered position. In other words, the covers 36 of the shelf connectors 28 engage and rest upon the tops 30 of the backboard connectors to limit downward movement of the shelf 16 on the embossments 26. Once in the cantilevered position, the upward movement of the shelf 16 out of the cantilevered position is limited by a pair of detents 40, i.e., a detent 40 disposed above each of the embossments 26 for engaging the covers 36 of the C-shaped channels for retaining the shelf 16 in the cantilevered position.

The shelf 16 includes a shelf surface 42 with a back wall 44 extending between ends and sidewalls 46 having upper and lower edges 48 and 50 extending forwardly from the ends of the back wall 44. The C-shaped channels are disposed in the back wall 44 and extend into the shelf, i.e., inwardly of the plane of the back wall 44. The walls 44 and 46 extend above and below the shelf surface 42 and strengthening ribs 52 are disposed on the bottom 60 of the shelf 16 and on the back of the backboard 12 (not shown) as is customary in components molded in plastic material. In addition, the shelf 16 includes a cleat 54 projecting forwardly of the front portion for winding a chord thereabout. For example, an iron may be set upon the shelf with the electrical chord thereof wound around the cleat 54 during non-use. The sidewalls 46 present an opening 56 to the shelf surface 42 just rearward of the cleat 54.

Figure 2:
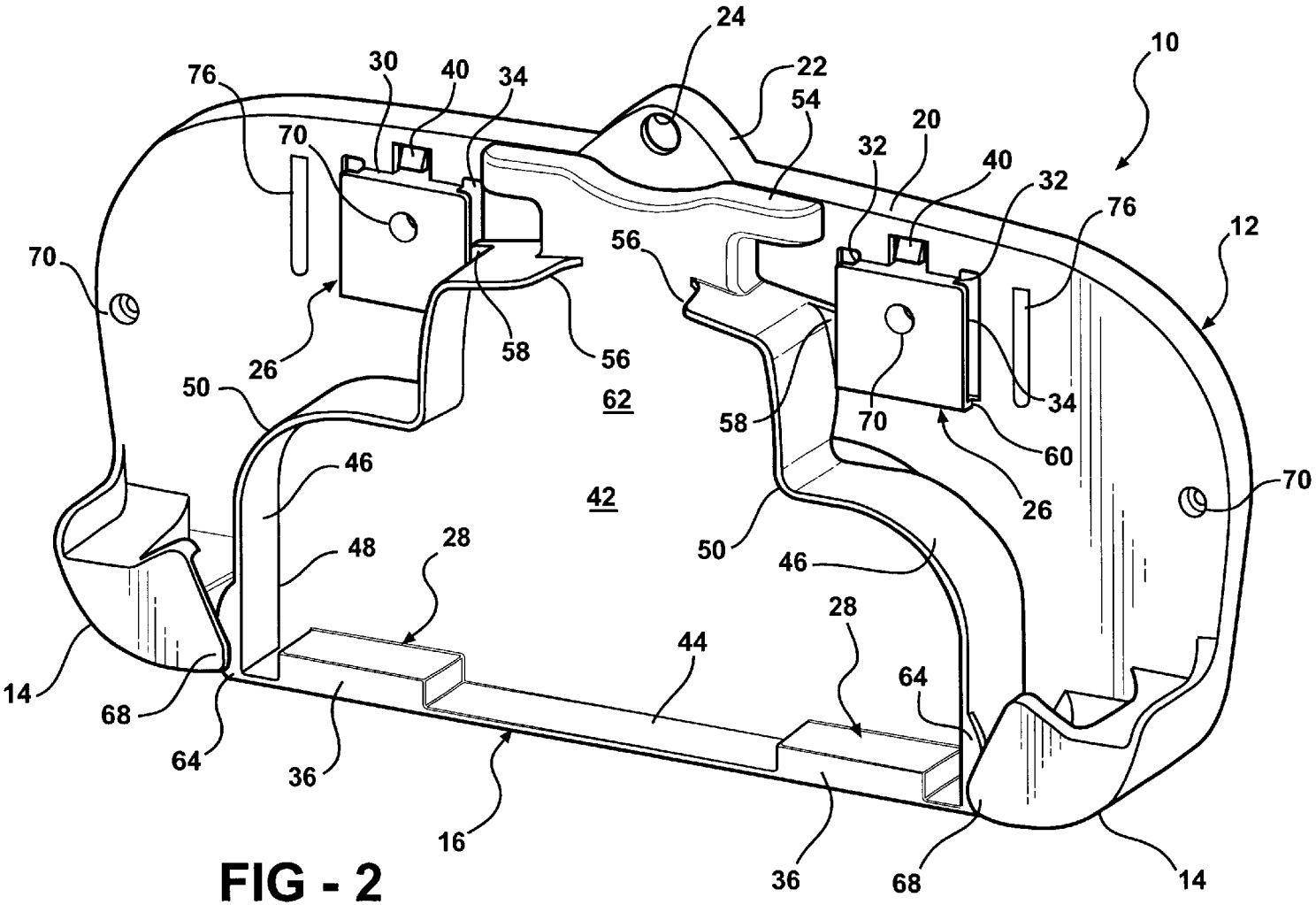
FIG. 2 is a perspective view of the assembly in the storage position.
Figure 3:
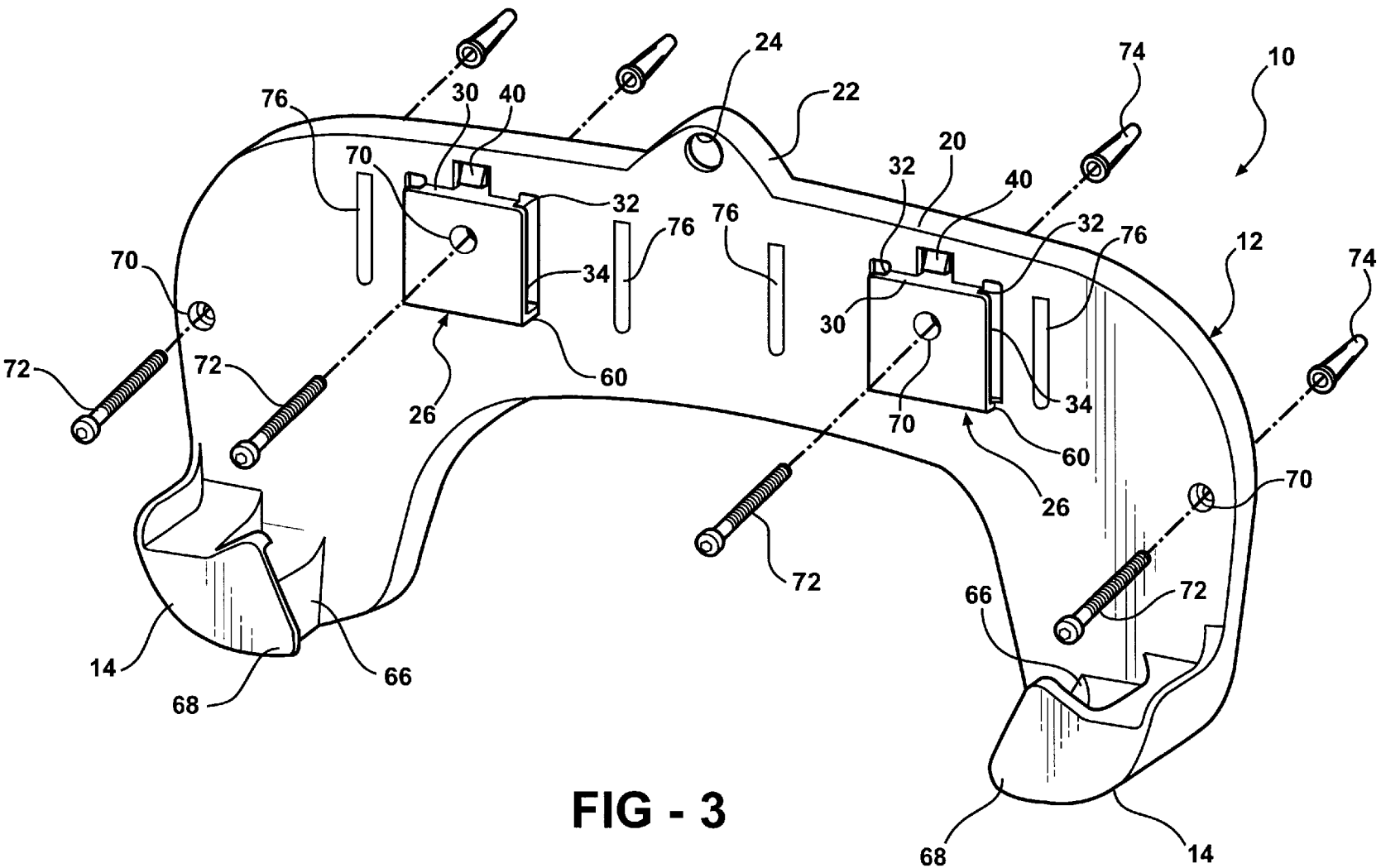
FIG. 3 is a perspective view showing the method of mounting to a support structure.

Alternatively or in combination, the coupling comprises a retainer for removably supporting the shelf 16 in a storage position extending parallel and in overlapping relationship to the backboard 12, as shown in FIGS. 1 and 2. More specifically, the retainer includes a hanger comprising projections 58 disposed on the shelf 16 for engaging the backboard connector 26 for suspending the shelf 16 in the storage position. The embossments include a bottom 60 at the lower extremity of each of the inside facing grooves and the hanger includes a pair of the projections 58 extending in opposite directions from the shelf 16 for sliding engagement with the inside grooves and resting upon the bottoms 60 for suspending the shelf 16 from the backboard 12 in the storage position, as shown in FIG. 2. The shelf 16 defines a front portion 62 more narrow than the distance between the ends of the back wall 44 and less than the distance between the inside grooves with the projections 58 being disposed on opposite sides of the front portion 62 of the shelf 16 and at the lower edges 50 of the sidewalls 46.

The retainer may also include at least one and preferably a pair of tabs 64 extending laterally from the shelf 16 for engaging one of the arms 14 in the storage position to retain the shelf 16 inside of the arms 14 and in the parallel relationship to the backboard 12. The tabs 64 extend laterally from the upper edges 48 of the sidewalls 46 at the ends of the back wall 44. More specifically, each of the arms 14 projects outwardly from the backboard 12 through an upwardly and inwardly inclined surface 66 for receiving the diverging legs of an ironing board to an inwardly directed finger 68 for retaining the legs on the inclined surface 66 and for overlying one of the tabs 64 when the shelf 16 is in the storage position, as shown in FIG. 2.

A plurality of mounting holes 70 extend thorough the embossments and the backboard 12 for mounting the backboard 12 to a structure as by screws 72 and anchors 74. The various openings on either side of the embossments are for facilitating the molding of the backboard 12 and removal of the mold dies. The tapers 76 project out from the backboard 12 and increase in thickness in the downward direction for a wedging action against the back wall 44 of the shelf 16 as the shelf 16 is slid into engagement with the backboard connectors 26.

Figure 4:
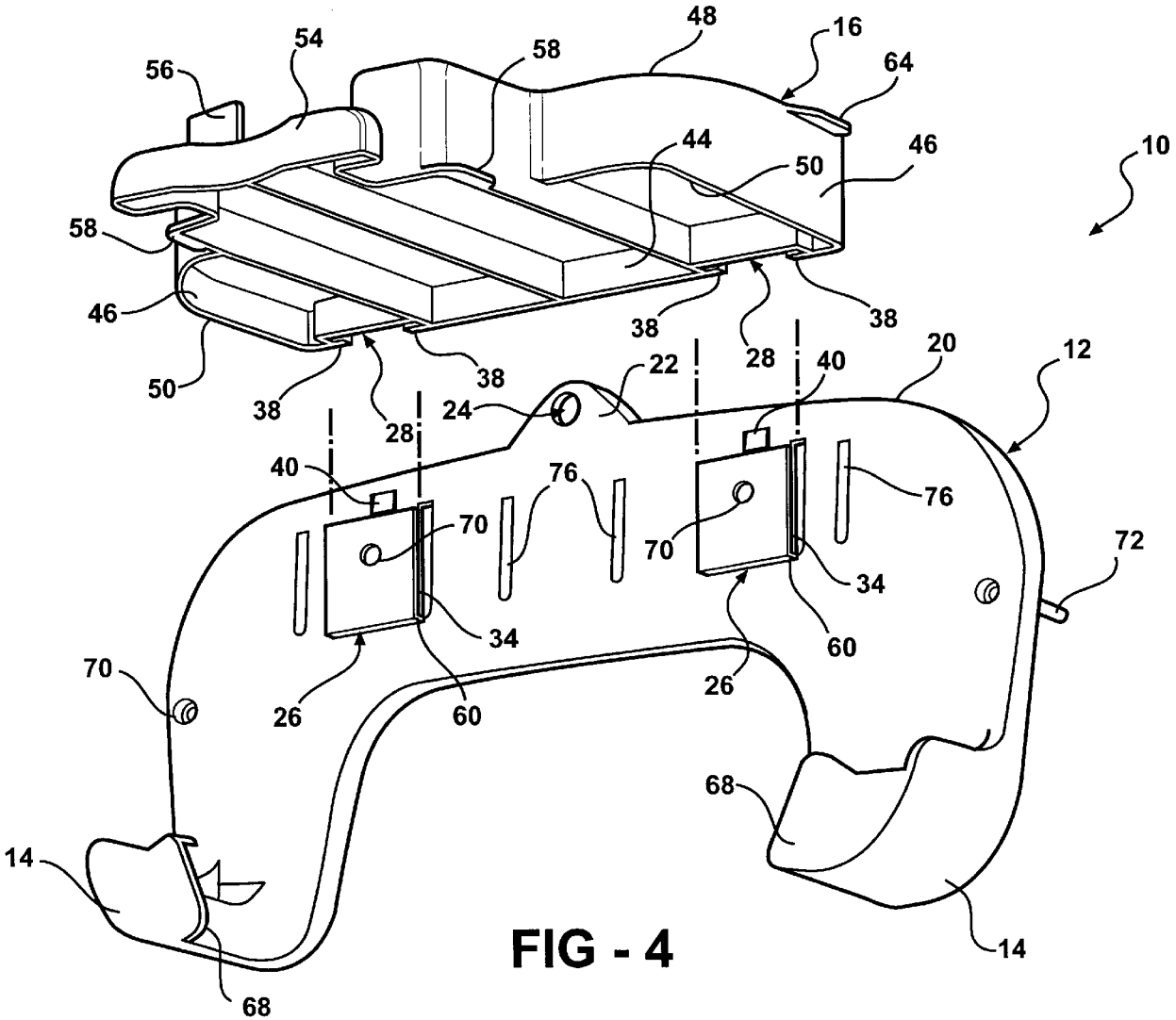
FIG. 4 is an exploded perspective view showing the mechanical connection of the shelf to the backboard.

As alluded to above, the components are preferably injection molded of an organic polymeric material, i.e., a plastic material. The shelf 16 is placed in the storage or shipping position shown in FIG. 2 with the shelf surface 42 facing outward and the projections 58 disposed in the grooves behind the flanges 34 and engaging the bottoms 60 of the embossments. To prevent the shelf 16 from swinging outwardly, the tabs 64 overlap and are retained behind the fingers 68. A wrapper 18 may be placed around the components 12 and 16 in this stored position for shipping and display in a retail store. Upon purchase of the components packaged as shown in FIG. 1, the user would remove the shelf 16 from the stored position and slide the tongues 38 into the grooves (as shown in FIG. 4) until the covers 36 engage the tops 30 for supporting the shelf 16 in the cantilevered position (as shown in FIG. 5). The user may also remove the shelf 16 from the backboard 12 and replace the shelf 16 in the storage position.

Obviously, many modifications and variations of the present invention are possible in light of the above teachings. The invention may be practiced otherwise than as specifically described within the scope of the appended claims, wherein that which is prior art is antecedent to the novelty set forth in the "characterized by" clause. The novelty is meant to be particularly and distinctly recited in the "characterized by" clause whereas the antecedent recitations merely set forth the old and well-known combination in which the invention resides. These antecedent recitations should be interpreted to cover 36 any combination in which the incentive novelty exercises its utility. In addition, the reference numerals in the claims are merely for convenience and are not to be read in any way as limiting.

What is claimed is:

1. An ironing organizer assembly comprising;

a backboard (12) including arms (14) for cradling the legs of an ironing board, and a shelf (16) for projecting from said backboard (12), a backboard connector (26) and a shelf connector (28) that mechanically interconnect with one another for supporting said shelf 16 in a cantilevered position extending forwardly from said backboard (12), and a retainer separate from said connectors (26, 28) for removably supporting said shelf (16) in a storage position extending parallel and in overlapping relationship to said backboard (12).

2. An assembly as set forth in claim 1 wherein said retainer includes a hanger disposed on said shelf (16) for engaging said backboard connector (26) for suspending said shelf (16) in said storage position.

3. An ironing organizer assembly comprising;

a backboard (12) including arms (14) for cradling the legs of an ironing board, a shelf (16) for projecting from said backboard (12), and a coupling for removably connecting said shelf (16) to said backboard (12) including a backboard connector (26) and a shelf connector (28) that mechanically interconnect with one another for supporting said shelf (16) in a cantilevered position extending forwardly from said backboard (12), and a hanger disposed on said shelf (16) for engaging said backboard connector (26) for removably suspending said shelf (16) in a storage position extending parallel and in overlapping relationship to said backboard, at least one tab (64) extending laterally from said shelf (16) for engaging one of said arms (14) in said storage position to retain said shelf (16) inside of said arms (14) and in said parallel relationship to said backboard (12).

4. An assembly as set forth in claim 3 wherein said backboard connector (26) includes a pair of embossments spaced laterally from one another and each having a top (30) and spaced sides (32) with a pair of flanges (34) extending in opposite directions from said sides (32) to define inside grooves facing one another and outside grooves, and said shelf connector (28) includes a pair of C-shaped channels each with a cover (36) and opposing tongues (38) for sliding said tongues (38) into said grooves with said cover (36) engaging said top (30) for supporting said shelf (16) in said cantilevered position.

5. An assembly as set forth in claim 4 wherein said embossments include a bottom (60) at the lower extremity of each of said inside facing grooves and said hanger includes a pair of projections (58) extending in opposite directions from said shelf (16) for sliding engagement with said inside grooves and resting upon said bottoms (60) for suspending said shelf (16) from said backboard (12) in said storage position.

6. An assembly as set forth in claim 5 including a detent (40) disposed above each of said embossments for engaging said covers (36) of said C-shaped channels for retaining said shelf (16) in said cantilevered position.

7. An assembly as set forth in claim 5 wherein said shelf (16) includes a shelf surface (42) with a back wall (44) extending between ends and sidewalls (46) having upper and lower edges (50) extending forwardly from said ends of said back wall (44), said C-shaped channels being disposed in said back wall (44) and said tabs (64) extending laterally from said upper edges (48) of said sidewalls (46) at said ends of said back wall (44).

8. An assembly as set forth in claim 7 wherein said shelf (16) defines a front portion (62) more narrow than the distance between said ends of said back wall (44) and less than the distance between said inside grooves with said projections (58) being disposed on opposite sides of said front portion (62) of said shelf (16) and at said lower edges (50) of said sidewalls (46).

9. An assembly as set forth in claim 8 wherein said shelf (16) includes a cleat (54) projecting forwardly of said front portion (62) for winding a chord thereabout.

10. An assembly as set forth in claim 8 wherein each of said arms (14) projects outwardly from said backboard (12) through an upwardly and inwardly inclined surface (66) for receiving the diverging legs of an ironing board to an inwardly directed finger (68) for retaining the legs on said inclined surface (66) and for overlying one of said tabs (64) when said shelf (16) is in said storage position.

11. An assembly as set forth in claim 10 including mounting holes (70) extending through said embossments for mounting said backboard (12) to a structure.

12. An assembly as set forth in claim 10 wherein said backboard (12) includes an upper shoulder (20) and a nose (22) extending upwardly from said upper shoulder (20) and defining a hole therethrough.

13. An assembly as set forth in claim 12 including a wrapper surrounding said backboard (12) and said shelf (16) in said storage position and engaging said upper shoulder (20) and defining an opening (24) with said nose (22) extending therethrough.

14. An ironing organizer assembly comprising;

a backboard (12) including arms (14) for cradling the legs of an ironing board, a shelf (16) for projecting from said backboard (12), a coupling for removably connecting said shelf (16) to said backboard (12), said backboard connector (26) including a pair of embossments spaced laterally from one another and each having a top (30) and spaced sides (32) with a pair of flanges (34) extending in opposite directions from said sides (32) to define inside grooves facing one another and outside grooves, and said shelf connector (28) including a pair of C-shaped channels each with a cover (36) and opposing tongues (38) for sliding said tongues (38) into said grooves with said cover (36) engaging said top (30) for supporting said shelf (16) in said cantilevered position.

15. An assembly as set forth in claim 14 including a detent (40) disposed above each of said embossments for engaging said covers (36) of said C-shaped channels for retaining said shelf (16) in said cantilevered position.

16. An assembly as set forth in claim 1 including a wrapper surrounding said backboard (12) and said shelf (16) in said storage position.

* * * * *